US012156603B2

(12) United States Patent
Foucha

(10) Patent No.: US 12,156,603 B2
(45) Date of Patent: Dec. 3, 2024

(54) BEDDING WITH VIEWING LENSES

(71) Applicant: Lillian A. Foucha, East Orange, NJ (US)

(72) Inventor: Lillian A. Foucha, East Orange, NJ (US)

( * ) Notice: Subject to any disclaimer, the term of this patent is extended or adjusted under 35 U.S.C. 154(b) by 156 days.

(21) Appl. No.: 18/154,889

(22) Filed: Jan. 16, 2023

(65) Prior Publication Data

US 2023/0292939 A1 Sep. 21, 2023

Related U.S. Application Data

(60) Provisional application No. 63/301,534, filed on Jan. 21, 2022.

(51) Int. Cl.
*A47G 9/02* (2006.01)

(52) U.S. Cl.
CPC ..... *A47G 9/0223* (2013.01)

(58) Field of Classification Search
CPC ..... A47G 9/02; A47G 9/0207; A47G 9/0223; A47G 9/023; A47G 9/0238; A47G 9/0284; A41D 13/1218; A61B 46/00; A61B 46/20
See application file for complete search history.

(56) References Cited

U.S. PATENT DOCUMENTS 2,302,844 A * 11/1942 Ebbott ..... A47G 9/0223 2/88
3,325,832 A * 6/1967 Malicki ..... A47G 9/0238 5/495
3,798,676 A * 3/1974 Shanks ..... A41D 13/00 2/69.5
3,799,161 A * 3/1974 Collins ..... A61B 46/00 128/854
3,826,253 A * 7/1974 Larsh ..... A61B 46/00 128/854
4,027,665 A * 6/1977 Scrivens ..... A61B 46/00 128/854
4,062,076 A * 12/1977 Albertson ..... A47G 9/0207 2/69.5

(Continued)

FOREIGN PATENT DOCUMENTS

JP 3214898 U * 2/2018
SE 443502 B * 3/1986

OTHER PUBLICATIONS

Kara Layne, "Easy DIY Halloween Costume Ideas: Classic Ghost", https://karalayne.com/easy-diy-halloween-costume-idea-classic-ghost/ (Year: 2021).*

(Continued)

*Primary Examiner* — Eric J Kurilla
(74) *Attorney, Agent, or Firm* — Boudwin Intellectual Property Law; Daniel Boudwin

(57) ABSTRACT

A bedding with viewing lenses is provided including a flexible body having a first aperture therethrough. The first aperture is disposed on an upper portion of the flexible body, wherein the upper portion is defined above a first midline bisecting the flexible body between opposing lateral sides of the flexible body. A translucent lens is disposed within the first aperture, wherein the lens extends across an entirety of the first aperture. In some embodiments, a second aperture and lens is disposed on the flexible body to accommodate multiple individuals viewing through the bedding simultaneously.

18 Claims, 3 Drawing Sheets

(56) References Cited

U.S. PATENT DOCUMENTS 4,169,472 A * 10/1979 Morris ..... A61B 46/23 128/854
4,441,223 A * 4/1984 Yang ..... A47G 9/0207 5/494
4,903,710 A * 2/1990 Jessamine ..... A61B 46/30 128/849
5,038,798 A * 8/1991 Dowdy ..... A61B 46/00 128/853
5,074,616 A * 12/1991 Smith ..... A47C 7/66 297/184.13
5,813,407 A 9/1998 Busch
5,860,420 A * 1/1999 Wiedner ..... A61B 46/00 128/853
6,298,855 B1 * 10/2001 Baird ..... A61B 46/00 128/853
6,345,621 B1 * 2/2002 Chandler ..... A61B 46/00 128/853
6,481,791 B1 * 11/2002 Facchini ..... B60N 2/6063 297/184.12
6,547,325 B2 * 4/2003 Drost ..... B60N 2/2881 297/219.12
6,640,362 B1 * 11/2003 Kimball ..... A47G 9/0223 128/854
7,083,228 B1 * 8/2006 Al Sawan ..... B60N 2/2854 297/184.13
7,107,638 B2 * 9/2006 Wilson ..... A47G 9/0207 5/923
11,986,117 B1 * 5/2024 Holland ..... A47G 9/066
2003/0188753 A1 10/2003 Jascomb
2005/0262633 A1 12/2005 Haleem
2006/0207609 A1 * 9/2006 Gil ..... A61B 46/20 128/853
2008/0047063 A1 * 2/2008 Jay ..... A47G 9/0207 5/482
2012/0018580 A1 1/2012 Holvoet et al.
2014/0352063 A1 * 12/2014 Mitchell ..... A47G 9/0223 5/494
2015/0028639 A1 1/2015 Brown
2016/0227847 A1 * 8/2016 Gibbons ..... A41D 27/28
2017/0013896 A1 * 1/2017 Coombs ..... A41D 15/04
2021/0267390 A1 * 9/2021 Storm ..... A47G 9/0223
2023/0271096 A1 * 8/2023 Roberson ..... A47G 9/0253 5/482

OTHER PUBLICATIONS

Rachael Eve, "How to Make a Sheet Ghost Costume! Vlogtober Day 5!", https://www.youtube.com/watch?v=5ZwYS_KfOkl (Year: 2020).*

* cited by examiner

BEDDING WITH VIEWING LENSES

CROSS REFERENCE TO RELATED APPLICATIONS

This application claims the benefit of U.S. Provisional Application No. 63/301,534 filed on Jan. 21, 2022. The above identified patent application is herein incorporated by reference in its entirety to provide continuity of disclosure.

BACKGROUND OF THE INVENTION

The present invention relates to bedding. More particularly, the present invention pertains to bedding with viewing lenses that allow the user to view their surroundings while still being completely covered by the bedding.

Bedding, such as blankets, sheets, comforters, quilts, and the like are typically utilized to keep covered, warm, and comfortable. In addition to their natural warming properties, blankets can be utilized to provide a safe, private enclosure to increase user comfort. Individuals may desire to cover up to provide a personal space, or alternatively to keep their head warm under the bedding. However, by covering a user's head with bedding, the individual is unable to view their surroundings while so covered. In order to view a television, for example, the individual must lower the bedding to expose their head, thereby exposing their head to cold air or otherwise violating their enclosed safe space, which may lead to discomfort. In view of the above concerns, it is desirable to provide bedding having viewing lenses therein that can provide a window to the exterior surroundings while allowing the user to remain completely covered up under the bedding.

In light of the devices disclosed in the known art, it is submitted that the present invention substantially diverges in design elements from the known art and consequently it is clear that there is a need in the art for an improvement to existing bedding. In this regard, the instant invention substantially fulfills these needs.

SUMMARY OF THE INVENTION

In view of the foregoing disadvantages inherent in the known types of bedding now present in the known art, the present invention provides bedding wherein the same can be utilized for providing convenience for the user when viewing their surroundings while the bedding is drawn over the user's head.

The present system comprises a flexible body having a first aperture therethrough, wherein the first aperture is disposed on an upper portion of the flexible body. The upper portion is defined above a first midline bisecting the flexible body between opposing lateral sides of the flexible body. A translucent lens is disposed within the first aperture, wherein the lens extends across an entirety of the first aperture. In some embodiments, a second aperture is disposed through the flexible body, wherein a translucent lens is disposed within the second aperture, such that the lens extends across an entirety of the second aperture. In another embodiment, the first aperture is disposed on a first portion of the flexible body, and the second aperture is disposed on a second portion of the flexible body, wherein the first portion and the second portion are defined opposite a second midline bisecting the flexible body between an upper edge and a lower edge of the flexible body. In other embodiments, the first and second apertures are disposed colinearly along a line parallel to an upper edge of the flexible body.

In yet another embodiment, a flap is affixed to an interior surface of the flexible body adjacent to the first aperture, wherein the flap is selectively movable between a raised position and a lowered position, wherein the flap overlies the first aperture when in the lowered position. In some embodiments, the flap is removably securable to the interior surface when in the lowered position via a flap fastener disposed on an interior surface of the flap and a complementary fastener disposed on the interior surface of the flexible body. In another embodiment, a secondary fastener is disposed on an opposing side of the first aperture as the complementary fastener, wherein the secondary fastener retains the flap in the raised position when secured to the flap fastener. In other embodiments, the lens is affixed to an interior surface of the flexible body and comprises a larger area than that of the first aperture. In yet another embodiment, the flexible body comprises an interior layer and an exterior layer, wherein the lens is affixed between the interior layer and the exterior layer within the first aperture. In some embodiments, the lens comprises a one-way lens such that the lens is opaque when viewed from an exterior side of the lens, and translucent when viewed from an interior side of the lens. In another embodiment, an exterior side of the lens is mirrored. In other embodiments, a color of the lens is equivalent to a color of the flexible body. In yet another embodiment, the lens is removably securable within the flexible body. In some embodiments, the lens comprises a corrective lens. In another embodiment, the lens includes an ultraviolet filter. In other embodiments, the lens is polarized to reduce glare. In yet another embodiment, the lens comprises a scratch resistant coating thereon. In some embodiments, the lens comprises a flexible material. In another embodiment, the lens comprises a heat resistant material. In other embodiments, the lens comprises a blue-light filter.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
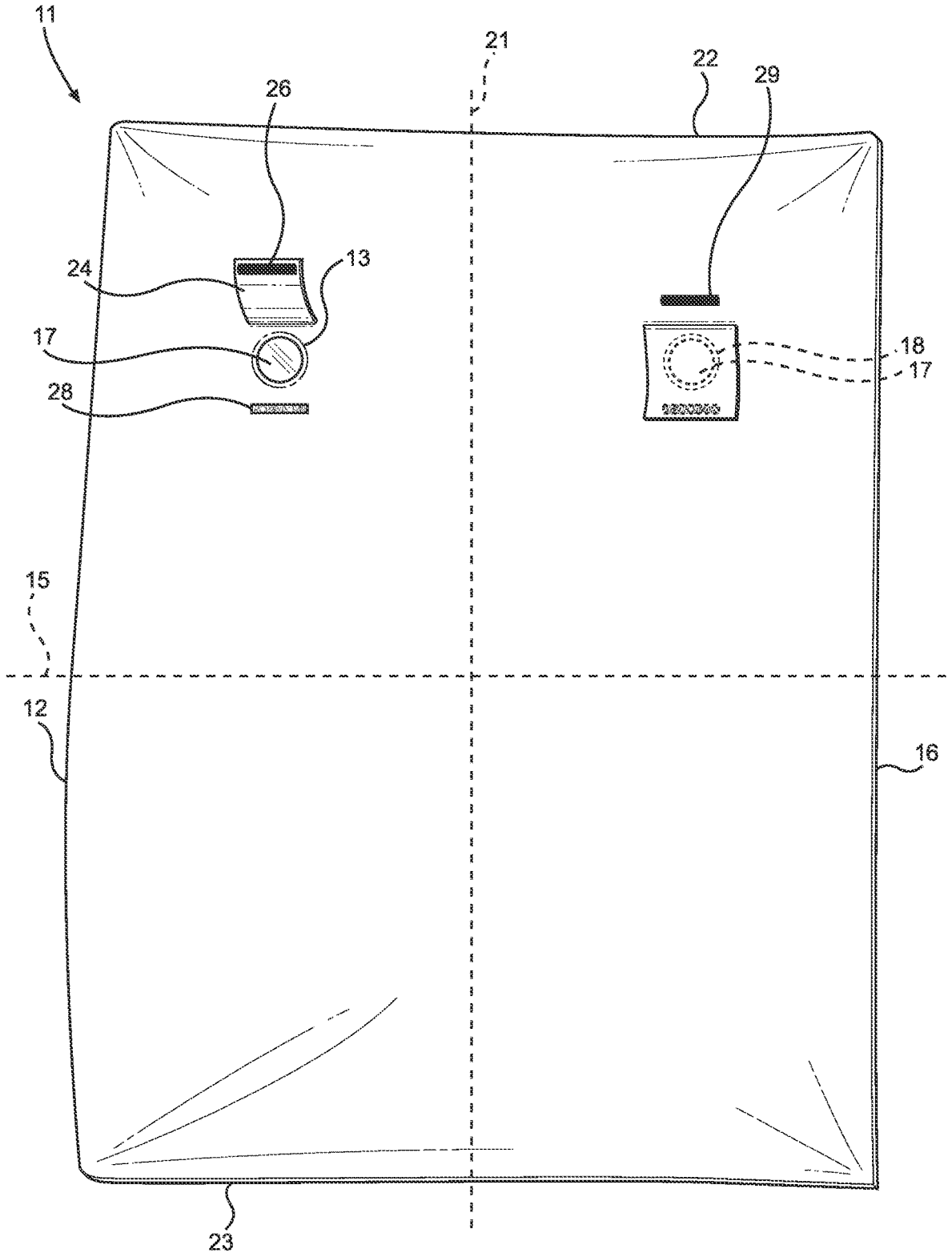
FIG. 1 shows a perspective view of an embodiment of the bedding with viewing lenses.

Reference is made herein to the attached drawings. Like reference numerals are used throughout the drawings to depict like or similar elements of the bedding with viewing lenses. The figures are intended for representative purposes only and should not be considered to be limiting in any respect.

Referring now to FIG. 1, there is shown a perspective view of an embodiment of the bedding with viewing lenses. The bedding with viewing lenses 11 comprises a flexible body 12, wherein the flexible body 12 is contemplated to include a bedspread, comforter, sheet, blanket, or other bedding. In some embodiments, the flexible body 12 comprises a breathable fabric material, such as cotton, such that airflow through the flexible body 12 is enabled, thereby preventing a stifling environment when the flexible body 12 is placed over a user's head. However, alternate fabric materials are also contemplated including, but not limited to, polyester, acrylic, flannel, fleece, microfiber, rayon, satin, sherpa, silk, synthetic materials, velvet, plush faux fur, or the like. The bedding with viewing lenses 11 is contemplated to comprise a variety of sizes suitable for each traditional bed size, including, but not limited to twin, double, queen, king, California king, or any other bed size. A first aperture 13 is disposed through the flexible body 12, wherein a translucent lens 17 is disposed within the first aperture 13 such that the lens 17 extends across an entirety of the first aperture 13. The first aperture 13 is disposed on an upper portion 14 of the flexible body 12, wherein the upper portion 14 is disposed above a first midline 15 extending between opposing lateral sides 16 of the flexible body 12. In this manner, the first aperture 13 is positioned to align with a head of a user when the flexible body 12 is disposed over an entirety of the user's body. In the shown embodiment, a second aperture 18 is disposed through the flexible body 12, wherein the second aperture 18 further comprises a translucent lens 17 therein such that the lens 17 extends across an entirety of the second aperture 18. In the shown embodiment, the second aperture 18 is disposed colinearly with respect to the first aperture 13, such that the first and second apertures 13, 18 are disposed parallel with an upper edge 22 of the flexible body 12. In this manner, the second aperture 18 is positioned to allow a second user to visualize an area external to the flexible body 12 when drawn over each users' head. In the shown embodiment, the first and second apertures 13, 18 are mirrored opposite a second midline 21 extending between the upper edge 22 and a lower edge 23 of the flexible body 12, such that the second midline 21 defines a first portion 19 of the flexible body 12 and a second portion 20 of the flexible body 12. In the shown embodiment, the first aperture 13 is disposed on the first portion 19, whereas the second aperture 18 is disposed on the second portion 20.

Figure 2A:
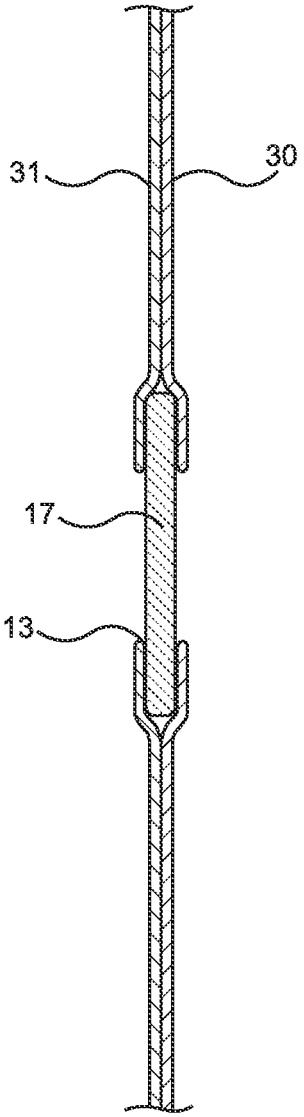
FIG. 2A shows a cross-sectional view of an embodiment of the bedding with viewing lenses.

The lenses 17 are contemplated to comprise a variety of materials, such as, but not limited to, glass and plastic, wherein the lenses 17 may be rigid or flexible, respectively. As such, the flexible lenses 17 may bend or fold in order to conform to the flexibility of the flexible body 12. In some embodiments, the lenses 17 comprise a heat resistant material, such that the bedding with viewing lenses 11 can be machine washed and dried without damaging the lenses 17. In some embodiments, the lenses 17 comprise a colored exterior surface, wherein the color of each lens 17 matches a color of the flexible body 12. In this manner, the lenses 17 are configured to blend into the material of the flexible body 12, such that the lenses 17 are not readily observable. In another embodiment, the lenses 17 comprise one-way lenses, wherein each lens 17 is opaque when viewed from an external side (as shown in FIG. 2A, 32) thereof, and translucent when viewed from an interior side (as shown in FIG. 2A, 33) thereof. In this manner, a user disposed underneath the flexible body 12 can visualize the surroundings exterior to the flexible body 12, however, an outside observer cannot see through the lens 17 under the flexible body 12. The lenses 17 are contemplated to comprise various sizes to accommodate the needs of various uses, wherein each lens 17 of the first and second apertures 13, 18 comprise the same size. In some embodiments, the lenses 17 comprise corrective lenses configured to accommodate vision limitations of a user, such that the user need not wear glasses, contact lenses, or other corrective lenses while utilizing the bedding with viewing lenses 11. In some embodiments, the lenses 17 further comprise ultraviolet filters, blue-light filters, glare reducing polarization, scratch resistant coatings, or the like.

Figure 2B:
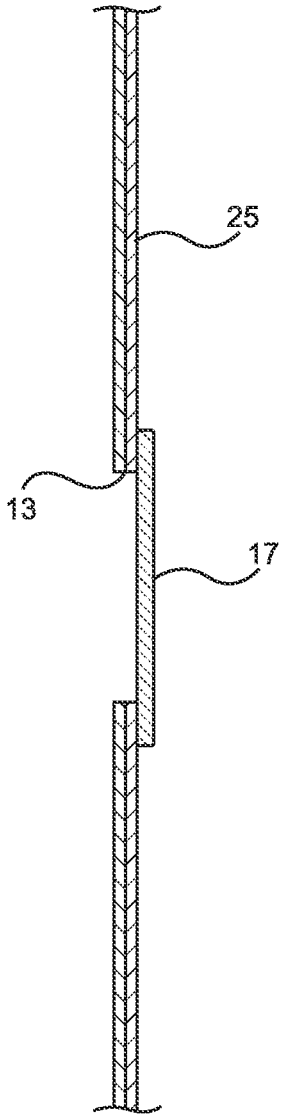
FIG. 2B shows a cross-sectional view of an alternate embodiment of the bedding with viewing lenses.

In the shown embodiment, the bedding with viewing lenses 11 further comprises a flap 24 affixed to an interior surface (as shown in FIG. 2B, 25) of the flexible body 12, wherein the flap 24 selectively moves between a raised position and a lowered position, wherein the lowered position the flap 24 overlies one of the first and second apertures 13, 18. In this manner, the flap 24 can be secured over each aperture 13, 18 when the user does not wish to view the surroundings to operate as traditional bedding. In the shown embodiment, each of the first and second apertures 13, 18 comprise an associated flap 24. In the shown embodiment, the flap 24 is removably securable to the interior surface of the flexible body 12 via a flap fastener 26 affixed to an interior surface 28 of the flap 24 and a complementary fastener 27 affixed to the interior surface of the flexible body 12, such that the flap 24 is retained in the lowered position. In the shown embodiment, a secondary fastener 29 is affixed to the interior surface of the flexible body 12 opposite the complementary fastener 27, wherein the flap fastener 26 can be removably secured to the secondary fastener 29 to retain the flap 24 in the raised position.

Referring now to FIGS. 2A and 2B, there is shown a cross-sectional view of an embodiment of the bedding with viewing lenses and a cross-sectional view of an alternate embodiment of the bedding with viewing lenses, respectively. Each lens 17 is affixed to the flexible body within an associated aperture. In the illustrated embodiment of FIG. 2A, the flexible body comprises an interior layer 30 affixed to an exterior layer 31, wherein padding may be placed between each layer 30, 31. In the shown embodiment, the lens 17 is affixed within the first aperture 13 between the interior and exterior layers 30, 31. The lens 17 may be sewn into the flexible body, affixed into the flexible body with adhesive, or another fastening means. In such embodiments, the each lens 17 is integral with the flexible body, however, in alternate embodiments, the lenses 17 may be removably securable within the flexible body to allow each lens to be removed before washing the bedding with viewing lenses. In such embodiments, a pocket may be formed about a border of the first aperture 13, wherein the lens 17 is inserted into the pocket. In such embodiments, the pocket is dimensioned to frictionally engage the lens 17 therein. In the illustrated embodiment of FIG. 2B, the lens 17 is affixed to the interior surface 25 of the flexible body, such that the lens 17 comprises a larger area than that of the first aperture 13. In this manner, the lens 17 extends over an entirety of the first aperture 13. Similarly, the lens 17 may be permanently affixed to the interior surface 25 via adhesive or mechanical connections such as stitching.

Figure 3:
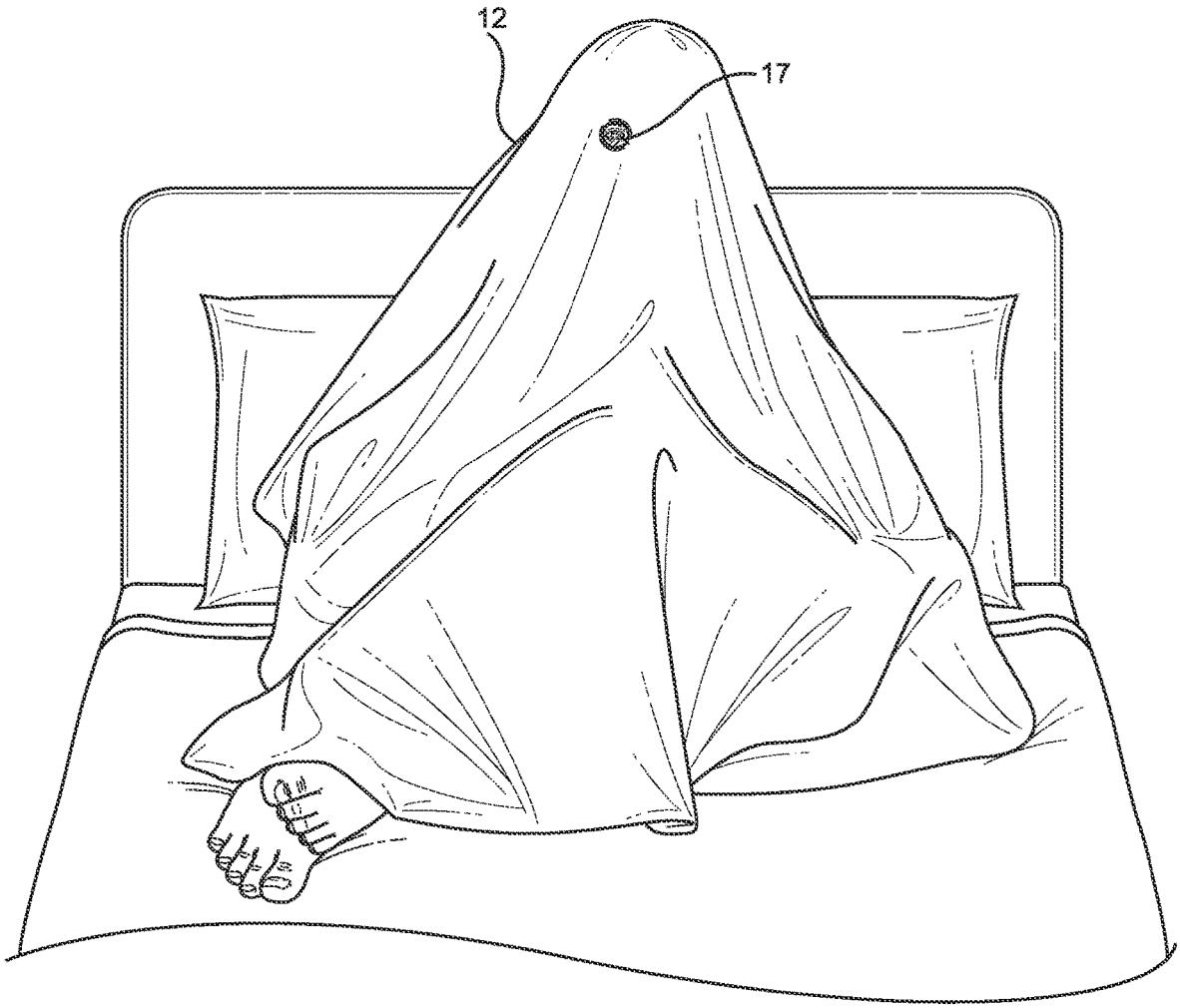
FIG. 3 shows a perspective view of an embodiment of the bedding with viewing lenses in use.

Referring now to FIG. 3, there is shown a perspective view of an embodiment of the bedding with viewing lenses in use. In one use, the flexible body 12 is placed over the user's body and head, such that at least one aperture and associated lens 17 is disposed over an eye of the user. In this manner, the bedding may be used to define an enclosed space over the user, while the lens 17 provides visibility to the area surrounding the user. In some embodiments, the user can raise or lower the flap disposed along the interior surface of the flexible body 12 to selectively visualize the area external to the enclosed space, or prevent visualization of the external area. As the lenses 17 are contemplated to comprise corrective qualities, a user may rest under the flexible body 12 without their glasses or contacts in order to remain comfortable, but still retain visual clarity. Should another individual see the user resting beneath the flexible body 12, as the lenses 17 are contemplated to be opaque from an exterior side, mirrored, or an identical color as that of the flexible body 12, the other individual will be unable to determine whether the user is actively viewing the surrounding area or sleeping. In this manner, the user may surreptitiously surveil their surrounding area, watch television, or other desired viewing activity while in the comfort of the enclosed space provided by covering their head with the flexible body 12.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly, and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bedding with viewing lenses, comprising:

a flexible body having a first aperture therethrough;

wherein the first aperture is disposed on an upper portion of the flexible body;

wherein the upper portion is defined above a first midline bisecting the flexible body between opposing lateral sides of the flexible body;

a translucent lens disposed within the first aperture, wherein an exterior side of the lens is mirrored;

wherein the lens extends across an entirety of the first aperture; and a flap affixed to an interior surface of the flexible body adjacent to the first aperture, the interior surface facing a user while in use, wherein the flap is selectively movable between a raised position and a lowered position, wherein the flap overlies the first aperture when in the lowered position.

2. The bedding with viewing lenses of claim 1, further comprising a second aperture disposed through the flexible body, wherein a translucent lens is disposed within the second aperture, such that the lens extends across an entirety of the second aperture.

3. The bedding with viewing lenses of claim 2, wherein the first aperture is disposed on a first portion of the flexible body, and the second aperture is disposed on a second portion of the flexible body, wherein the first portion and the second portion are defined opposite a second midline bisecting the flexible body between an upper edge and a lower edge of the flexible body.

4. The bedding with viewing lenses of claim 2, wherein the first and second apertures are disposed colinearly along a line parallel to an upper edge of the flexible body.

5. The bedding with viewing lenses of claim 1, wherein the flap is removably securable to the interior surface when in the lowered position via a flap fastener disposed on an interior surface of the flap and a complementary fastener disposed on the interior surface of the flexible body.

6. The bedding with viewing lenses of claim 5, further comprising a secondary fastener disposed on an opposing side of the first aperture as the complementary fastener, wherein the secondary fastener retains the flap in the raised position when secured to the flap fastener.

7. The bedding with viewing lenses of claim 1, wherein the lens is affixed to an interior surface of the flexible body and comprises a larger area than that of the first aperture.

8. The bedding with viewing lenses of claim 1, wherein the flexible body comprises an interior layer and an exterior layer, wherein the lens is affixed between the interior layer and the exterior layer within the first aperture.

9. The bedding with viewing lenses of claim 1, wherein the lens comprises a one-way lens such that the lens is opaque when viewed from an exterior side of the lens, and translucent when viewed from an interior side of the lens.

10. The bedding with viewing lenses of claim 1, wherein a color of the lens is equivalent to a color of the flexible body.

11. The bedding with viewing lenses of claim 1, wherein the lens is removably securable within the flexible body.

12. The bedding with viewing lenses of claim 1, wherein the lens comprises a corrective lens.

13. The bedding with viewing lenses of claim 1, wherein the lens includes an ultraviolet filter.

14. The bedding with viewing lenses of claim 1, wherein the lens is polarized to reduce glare.

15. The bedding with viewing lenses of claim 1, wherein the lens comprises a scratch resistant coating thereon.

16. The bedding with viewing lenses of claim 1, wherein the lens comprises a flexible material.

17. The bedding with viewing lenses of claim 1, wherein the lens comprises a heat resistant material.

18. The bedding with viewing lenses of claim 1, wherein the lens comprises a blue-light filter.

* * * * *